US008764331B1

(12) United States Patent
Lubanski

(10) Patent No.: US 8,764,331 B1
(45) Date of Patent: Jul. 1, 2014

(54) MARKER WITH REVERSE CLIP CAP

(71) Applicant: Jeffrey Lubanski, Edison, NJ (US)

(72) Inventor: Jeffrey Lubanski, Edison, NJ (US)

( * ) Notice: Subject to any disclaimer, the term of this patent is extended or adjusted under 35 U.S.C. 154(b) by 0 days.

(21) Appl. No.: 14/064,986

(22) Filed: Oct. 28, 2013

Related U.S. Application Data

(60) Provisional application No. 61/763,330, filed on Feb. 11, 2013.

(51) Int. Cl.
*B43K 23/02* (2006.01)
*B43K 23/12* (2006.01)

(52) U.S. Cl.
CPC ..... *B43K 23/126* (2013.01)
USPC ..... 401/131; 401/202; D19/121; D19/170

(58) Field of Classification Search
USPC ..... 401/98, 131, 202, 213, 243, 245–247, 401/262, 269; 24/10 R, 11 R, 11 FE; D19/121, 170
See application file for complete search history.

(56) References Cited

U.S. PATENT DOCUMENTS 5,421,664 A * 6/1995 Okamoto ..... 401/213
6,022,159 A * 2/2000 Kossnar et al. ..... 401/35
7,172,359 B2 * 2/2007 Mock ..... 401/202

* cited by examiner

*Primary Examiner* — David Walczak
(74) *Attorney, Agent, or Firm* — Thomas J. Germinario

(57) ABSTRACT

A marker has a cap with a reverse clip, which opens toward the closed end of the cap, that is, in the same direction as the force applied to remove the cap, thereby allowing the cap to be removed with one hand without dislodging the reverse clip from its attachment. To facilitate single-handed removal and replacement of the marker, the cap has a semi-tubular cap extension, terminating in a flange from which the reverse clip extends. The cap extension acts as a guide for replacing the marker in the cap with one hand, while the flange provides a flat surface against which downward thumb pressure can be applied to separate the cap from the marker as the latter is pulled up with the other fingers of the same hand.

2 Claims, 2 Drawing Sheets

MARKER WITH REVERSE CLIP CAP

REFERENCE TO RELATED APPLICATION

The present application claims the benefit of the filing date of Provisional Application No. 61/763,330, filed Feb. 11, 2013, the disclosure of which is incorporated herein by reference.

BACKGROUND OF THE INVENTION

The present invention relates to the field of markers and pens, and more particularly to caps used to cover and protect the writing tips of markers and pens. As used herein, the term "marker" will be used to refer to any ink-based writing or marking implement.

Felt-tipped markers are commonly found in the tool belts of carpenters and other craftsmen to mark measurements on building materials. The problem faced by craftsmen in using such markers involves the removal of the cap, which requires the use of both hands—one to remove the cap and the other to hold the writing portion of the marker. This forces the craftsman to either lay down the tool or material that he/she is working with, or use his/her teeth to pull off the cap, thereby risking injury and/or dental damage.

The present invention provides an alternative cap design, which secures the marker/pen in place in a user's pocket or tool pouch, but allows the user to remove the marker/pen from the cap with one hand.

SUMMARY OF THE INVENTION

The principal feature of the marker of the present invention is a reverse clip cap, in which the clip extends and opens toward the enclosed end of the cap, instead of toward the open end, as in conventional markers. Since the direction of the force applied to the cap to separate the cap from the marker body will always be away from the open end of the cap, a conventional clip which opens toward the open end of the cap will inherently be pulled away from and free of its attachment to a tool belt, pocket or pouch when the cap is removed with one hand.

In the reverse clip design of the present invention, on the other hand, the reverse clip opens toward the closed end of the cap, that is, in the same direction as the force applied to remove the cap, thereby allowing the cap to be removed with one hand without dislodging the reverse clip from its attachment.

To facilitate single-handed removal and replacement of the marker, the cap of the present invention has a semi-tubular cap extension, terminating in a flange from which the reverse clip extends. The cap extension acts as a guide for replacing the marker in the cap with one hand, while the flange provides a flat surface against which downward thumb pressure can be applied to separate the cap from the marker as the latter is pulled up with the other fingers of the same hand.

In at least one embodiment of the present invention, the enclosed end of the cap contains an interior tubular channel which protects the marker tip and prevents it from drying out by exposure to ambient air.

The foregoing summarizes the general design features of the present invention. In the following sections, specific embodiments of the present invention will be described in some detail. These specific embodiments are intended to demonstrate the feasibility of implementing the present invention in accordance with the general design features discussed above. Therefore, the detailed descriptions of these embodiments are offered for illustrative and exemplary purposes only, and they are not intended to limit the scope either of the foregoing summary description or of the claims which follow.

DETAILED DESCRIPTION OF THE PREFERRED EMBODIMENT

Figure 1:
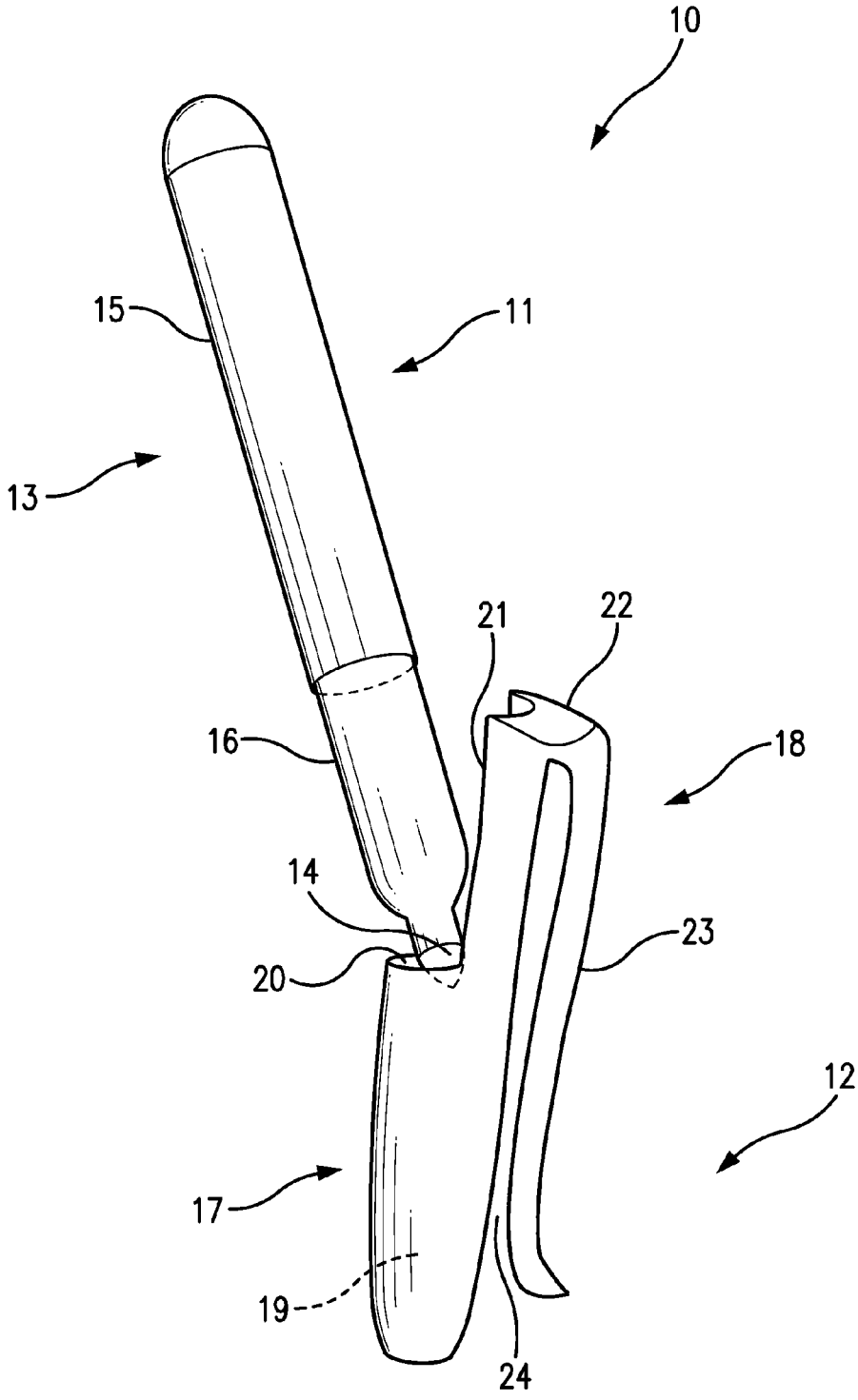
FIG. 1 is a perspective view of the preferred embodiment of the present invention, showing the marking member separated from the cap.

Referring to FIG. 1, a reverse clip marker, according to the preferred embodiment of the present invention 10, comprises a marking member 11 and a removable cap 12. The marking member 11 comprises an ink reservoir 13 and a marking tip 14. The ink reservoir 13 has a distal barrel 15 and a proximal tapered end 16 adjoining the marking tip 14.

The removable cap 12 fits over the marking member 11 and comprises a proximal crown section 17 and a distal clip section 18. The crown section 17 defines an internal crown cavity 19 and has a crown aperture 20, which snugly accepts the tapered end 16 and the marking tip 14 of the marking member 11.

The clip section 18 has a semi-tubular cap extension 21, which projects upward from the crown aperture 20 and terminates in a clip flange 22. Projecting downward from the clip flange 22 is a holding prong 23, in substantially parallel-spaced relation to the cap extension 21, so as to define, in conjunction with the cap extension 21 and the crown section 17, a U-shaped slot 24, which is adapted to snugly engage an attachment material inserted into the slot 24, thereby enabling the cap 12 to be securely attached to a belt, pocket or pouch.

Figure 2:
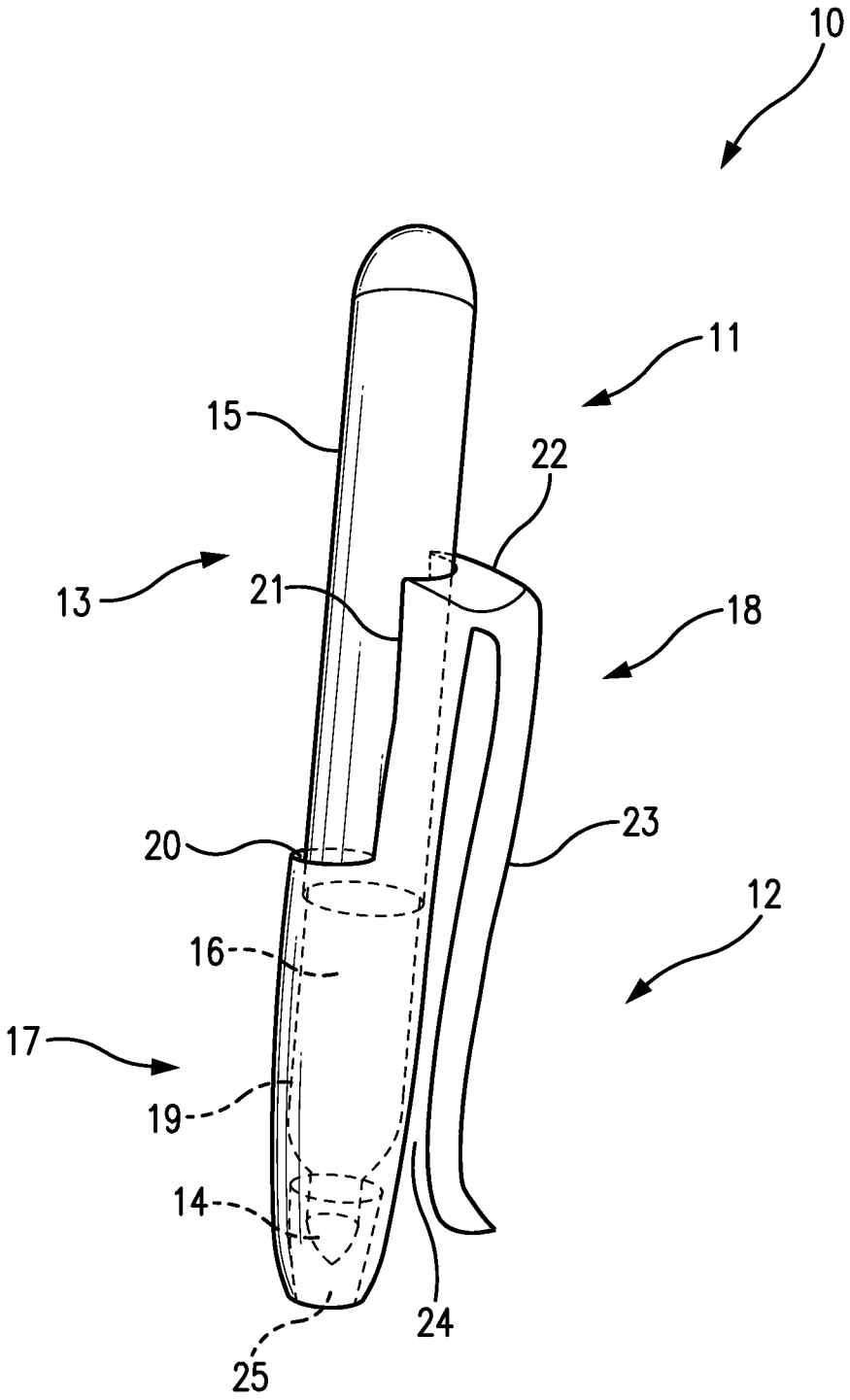
FIG. 2 is a perspective view of the preferred embodiment of the present invention, showing the marking member inserted into the cap.

Referring to FIG. 2, the enclosed end of the cap 12 contains within the crown cavity 19 a tubular, conical or frusto-conical shaped tip channel 25, which is adapted to receive and enclose the marking tip 14 of the marking member 11, thereby protecting the marking tip 14 from abrasive damage and from the drying effect of exposure to the air.

With this reverse clip configuration, the marking member 11 can be removed from the cap 12 by pressing the thumb of one hand downward on the clip flange 22 and, with one or more of the other fingers of the same hand wrapped around the barrel 15 of the marking member 11, lifting the marking member 11 out of the cap 12. When replacing the marking member 11 into the cap 12, the cap extension 21 acts as a guide along which the marking member 11 can slide into the cap 12.

Although the preferred embodiment of the present invention has been disclosed for illustrative purposes, those skilled in the art will appreciate that many additions, modifications and substitutions are possible, without departing from the scope and spirit of the present invention as defined by the accompanying claims.

What is claimed is:

1. A marker comprising:

a marking member, comprising a marking tip and an ink reservoir, wherein the ink reservoir has a distal barrel and a proximal tapered end adjoining the marking tip;

a removable cap, having an enclosed proximal end and an open distal end, wherein the cap fits over the marking member and comprises a proximal crown section and a distal clip section, and wherein the crown section defines an internal crown cavity which snugly accepts, through a crown aperture, the tapered end and the marking tip of the marking member, and wherein the clip section comprises an elongate, semi-tubular cap extension, having a proximal end which extends axially from the crown aperture, and having a distal end which terminates in a clip flange, and wherein the clip section further comprises an elongate holding prong, projecting substantially perpendicularly from the clip flange and extending and opening toward the enclosed proximal end of the cap in substantially parallel-spaced relation to the cap extension, so as to define, in conjunction with the cap extension and the crown section, an elongate U-shaped slot, which is adapted to snugly engage an attachment material inserted into the slot, thereby making the cap securely attachable to a belt, a pocket or a pouch.

2. The marker of claim 1, wherein the closed proximal end of the cap contains, within the crown cavity, a channel conformably adapted to receive and enclose the marking tip of the marking member, thereby protecting the marking tip and preventing the marker tip from drying out.

* * * * *